US010617909B2

(12) United States Patent
Pogue et al.

(10) Patent No.: US 10,617,909 B2
(45) Date of Patent: Apr. 14, 2020

(54) ABDOMINAL EXERCISE MACHINE

(71) Applicants: Connor Pogue, Waco, TX (US); Brian Pogue, Granbury, TX (US)

(72) Inventors: Connor Pogue, Waco, TX (US); Brian Pogue, Granbury, TX (US)

( * ) Notice: Subject to any disclaimer, the term of this patent is extended or adjusted under 35 U.S.C. 154(b) by 139 days.

(21) Appl. No.: 15/836,525

(22) Filed: Dec. 8, 2017

(65) Prior Publication Data

US 2018/0353807 A1 Dec. 13, 2018

Related U.S. Application Data

(60) Provisional application No. 62/431,989, filed on Dec. 9, 2016.

(51) Int. Cl.

| | |
|---|---|
| ***A63B 23/02*** | (2006.01) |
| ***A63B 21/00*** | (2006.01) |
| ***A63B 21/055*** | (2006.01) |
| ***A63B 21/04*** | (2006.01) |
| ***A63B 1/00*** | (2006.01) |

(52) U.S. Cl.

CPC ..... *A63B 23/0205* (2013.01); *A63B 1/00* (2013.01); *A63B 21/00069* (2013.01); *A63B 21/0428* (2013.01); *A63B 21/0552* (2013.01); *A63B 21/4043* (2015.10); *A63B 2210/50* (2013.01)

(58) Field of Classification Search

CPC ..... A63B 23/0205; A63B 21/0428; A63B 21/0552; A63B 21/4043; A63B 21/00069; A63B 2210/50

See application file for complete search history.

(56) References Cited

U.S. PATENT DOCUMENTS

| | | | | |
|---|---|---|---|---|
| 3,687,450 | A * | 8/1972 | Schollmeyer | A63B 21/023 482/123 |
| 4,634,119 | A * | 1/1987 | Pesthy | A63B 21/023 482/130 |
| 7,780,585 | B1 * | 8/2010 | Rivas | A63B 21/0552 482/140 |
| 2001/0036885 | A1 * | 11/2001 | Castellot, Jr. | A63B 21/012 482/79 |
| 2005/0250628 | A1 * | 11/2005 | Goldstein | A63B 21/0552 482/141 |
| 2006/0100074 | A1 * | 5/2006 | Murdoch | A63B 21/055 482/142 |
| 2012/0083394 | A1 * | 4/2012 | Gregor | A63B 21/00065 482/121 |

(Continued)

*Primary Examiner* — Sundhara M Ganesan

(57) ABSTRACT

An exercise machine including a hinged frame configured to fold about a hinge axis in a closed position and to unfold to an open position when in use; the hinged frame including a user support platform supported by the hinged frame, a first pair of lateral tracks disposed under the user support platform, a first pulley disposed on a first end of the hinged frame, and a second end opposite from the first end; a first carriage movably coupled to the first pair of lateral tracks; a primary cable having a first cable end coupled to the first carriage, passing through the first pulley, and a second end coupled to a first handle; and a first resistance mechanism configured to elastically resist longitudinal movement of the first carriage by the user, wherein movement of the first handle by the user causes movement of the first carriage and deformation of the first resistance mechanism.

20 Claims, 8 Drawing Sheets

(56) References Cited

U.S. PATENT DOCUMENTS

| | | | | |
|---|---|---|---|---|
| 2012/0283079 | A1* | 11/2012 | Solow | A63B 21/0552<br>482/142 |
| 2013/0337982 | A1* | 12/2013 | Williams | A63B 21/02<br>482/122 |
| 2014/0011645 | A1* | 1/2014 | Johnson | A63B 21/0552<br>482/121 |
| 2014/0031175 | A1* | 1/2014 | Peralo | A61H 1/02<br>482/66 |
| 2014/0100089 | A1* | 4/2014 | Kermath | A63B 21/023<br>482/133 |
| 2014/0309091 | A1* | 10/2014 | Tang | A63B 21/0552<br>482/130 |
| 2015/0065320 | A1* | 3/2015 | Anderson | A63B 21/0428<br>482/142 |

* cited by examiner

ABDOMINAL EXERCISE MACHINE

CROSS-REFERENCE TO RELATED APPLICATION

This application claims priority to U.S. provisional patent application No. 62/431,989, filed Dec. 9, 2016, all of which is hereby incorporated by reference for all purposes as if fully set forth herein.

BACKGROUND

Technical Field

The present, disclosure relates to abdominal exercise device.

Description of Related Art

There are a number of mechanical devices that have been invented over the years that have been used for core muscle exercise development with an emphasis on strength training of users' abdominal muscles. Many of these devices have been marketed as providing significant abdominal muscle enhancement and core muscle toning for a sculpted physique, yet few have provided significant real-world results in practice. Typically, devices focused on providing users with an abdominal exercise workout have failed to yield the significant abdominal muscle enhancements and sculpted body core muscles that are desired. One reason for such failure is that conventional mechanical devices have focused on Type I muscle fibers that are slow to fatigue and slow to hypertrophy.

DESCRIPTION OF THE DRAWINGS

The novel features believed characteristic of the embodiments of the present disclosure are set forth in the appended claims. However, the embodiments themselves, as well as a preferred mode of use, and further objectives and advantages thereof, will best be understood by reference to the following detailed description when read in conjunction with the accompanying drawings, wherein:

DESCRIPTION OF THE PREFERRED EMBODIMENT

Illustrative embodiments of the abdominal exercise machine are described below. In the interest of clarity, all features of an actual implementation may not be described in this specification. It will, of course, be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms such as "above," "below," "upper," "lower," or other like terms to describe a spatial relationship between various components or to describe the spatial orientation of aspects of such components should be understood to describe a relative relationship between the components or a spatial orientation of aspects of such components, respectively, as the devices, members, apparatuses, etc. described herein may be oriented in any desired direction.

Figure 1:
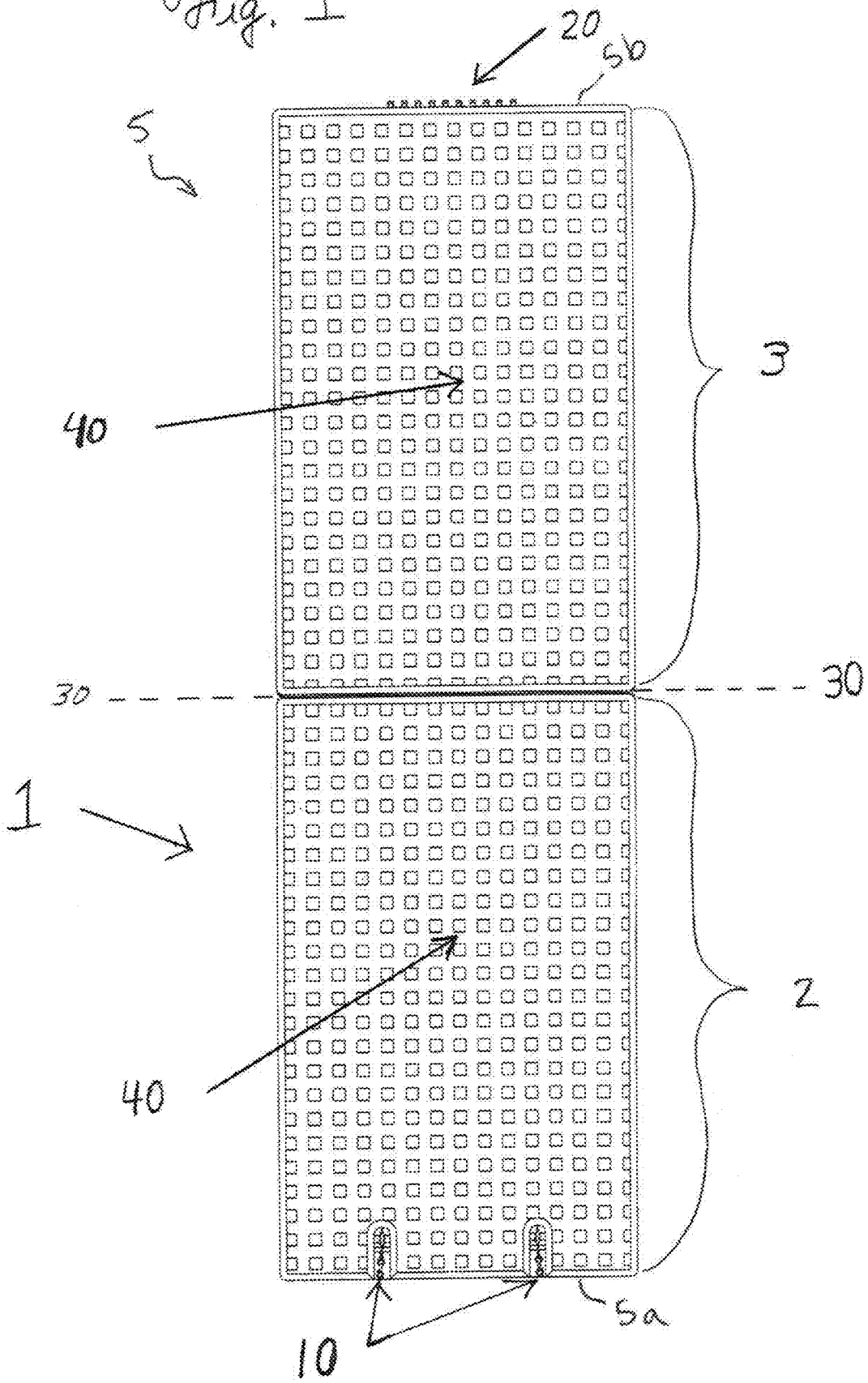
FIG. 1 is a top view of the abdominal exercise machine in its non-collapsed, fully extended position.

FIG. 1 shows the abdominal exercise machine 1 in its non-collapsed, elongated position when a user is going to perform abdominal exercises thereon. The main body of the abdominal exercise machine 1 (also called the "machine main body") is comprised of a hinged frame 5 an upper section 2 and a lower section 3 that are hingedly connected such that the abdominal exercise machine 1 may be collapsed to a closed position for storage or transport when the upper section 2 and the lower section 3 are folded together around the hinge axis 30. The upper section 2 and the lower section 3 of the main body of the machine 1 each have user support surfaces 40 that may be rigid planar surfaces, or may be rigid planar surfaces covered with padding or upholstery for the comfort of a user during exercise. The hinged frame 5 includes a first end 5*a* and a second end 5*b*.

The hinged frame 5 includes a first pair of lateral support tracks (not shown) that cooperate to form rigid carriage tracks (not shown) on both sides of the machine 1 when the machine 1 is in its unfolded position (e.g., open position). The hinged frame 5 houses a first carriage (not shown) that is internal to the hinged frame that may be reversibly moved along the first pair of lateral tracks during exertion of force by a user during the performance of abdominal exercise.

The hinged frame 5 includes rigid cross-member supports (not shown) that cooperate when the abdominal exercise machine is in its non-collapsed, elongated position to provide support to the user support surfaces 40. The user support surfaces 40 of the upper section 2 and the lower section 3 when taken together forma user support platform.

The exercise machine 1 can include two tension cables 10, each of which is connected to a tension cable (not shown), wherein the tension cables are connected on their other ends to the first carriage (not shown).

The exercise machine 1 can include a first plurality of attachment points 20 disposed on the second end 5*b* of the hinged frame 5. In an embodiment, the first plurality of attachment points 20 include frame connection points 22.

Figure 2:
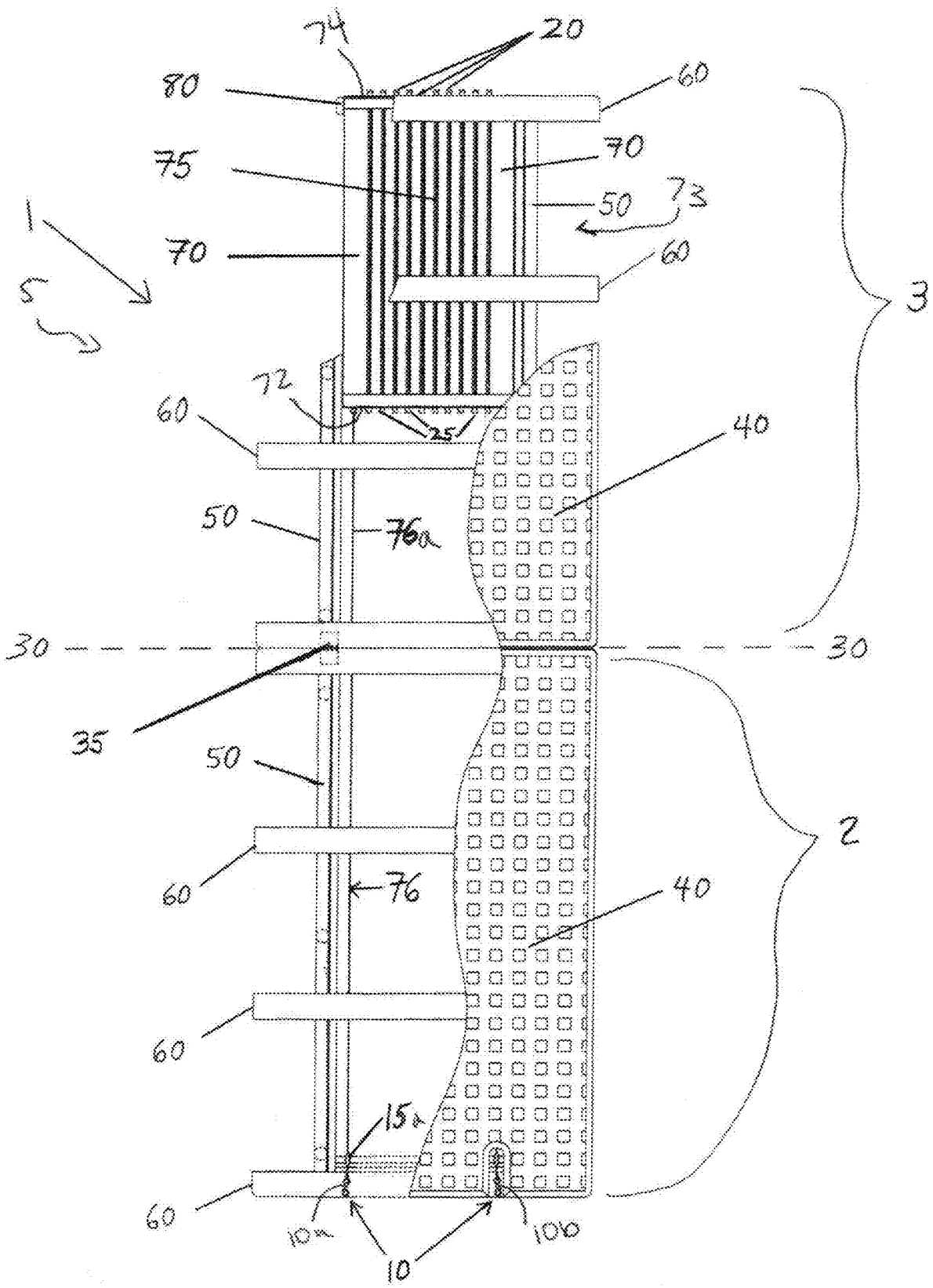
FIG. 2 is a top cross-sectional view of the abdominal exercise machine in its non-collapsed, fully extended position.
Figure 3:
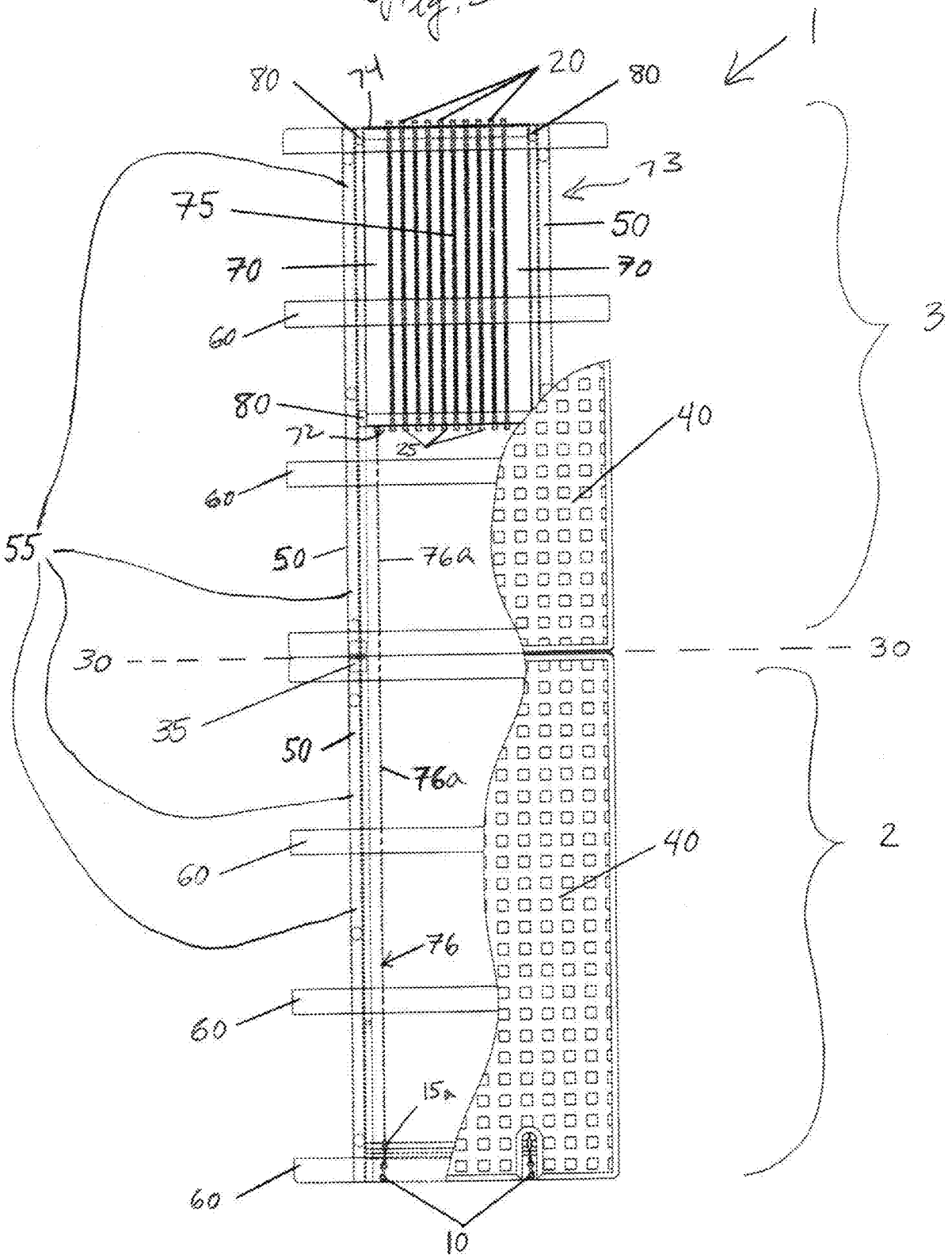
FIG. 3 is a top cross-sectional view of the abdominal exercise machine its non-collapsed, fully extended position.

FIGS. 2-3 illustrate top cross-sectional views of the abdominal exercise machine 1 in its open position. The upper section 2 and lower section 3 of the machine main body are hingedly connected by at least one hinge 35 that allows the upper section 2 and the lower section 3 to be folded together by pivoting said sections around the hinge axis 30 so that the machine can be stored or transported when not in use. In a preferred embodiment, the machine 1 includes at least two separate hinges 35. In an embodiment, the hinge axis 30 is in middle section of the frame.

The upper section 2 and lower section 3 of the user support surfaces 40 are rigidly attached to one or more cross-member supports 60 that are in turn rigidly attached to a first pair of lateral support tracks 50.

A first carriage 70 is disposed within the first pair of lateral support tracks 50 by means of at least two, and preferably at least four, carriage wheels 80 that are attached to the sides of the first carriage 70 and are movably disposed within the first pair of lateral support tracks 50 such that the carriage wheels 80 may rotate forward or backward within and along the length of the first pair of lateral support tracks 50 thereby allowing the first carriage 70 to be moved back and forth longitudinally along the length of, and within a plane bordered on two sides by, the first pair of lateral support tracks 50. In this manner, when the machine is in use in the open position, the first pair of lateral support tracks 50 of the upper section 2 and lower section 3 include two pairs of carriage tracks 55 that span the length of the hinged frame 5 with the first carriage 70 located between the two pairs of carriage tracks 55 such that the first carriage 70 may be moved back and forth by means of the carriage wheels 80 along the two pairs of carriage tracks 55 under the upper section 2 and lower section 3 of the user support platform 40. The first carriage 70 can include a first pulling end 72 and a first storage end 74. The first pulling end 72 is opposite from the first storage end 74.

The abdominal exercise machine 1 includes a first resistance mechanism 73 that includes a first plurality of elastic resistance components 75 that are each detachably connected to the first carriage 70 at one or more upper elastic tube attachments 25 disposed on a first pulling end 72 of the first carriage 70. In a preferred embodiment, the first plurality of attachment points 20 and the one or more upper elastic tube attachment points 25 are simply notches on opposing sides (e.g., the first pulling end 72 and the first storage end 74) of the first carriage 70 in which the ends of the elastic tubes may be detachably held. Alternatively, the first plurality of attachment points 20 and the upper elastic tube attachment points 25 may be rigid protrusions, fingers, rings or similar components that are attached to the first carriage 70 that accomplish the same purpose of detachably holding the ends of the elastic tubes 75, so long as the one or more elastic tubes 75 may be reversibly attached at the first plurality of attachment points 20 and the upper elastic tube attachment points 25 when no resistance against movement of the first carriage 70 from the elastic tubes 75 is desired. In some embodiments, the elastic resistance components 75 are attached to the first storage end 72 when not in use (e.g., when in the closed position and/or when not required by the user).

FIG. 2 illustrates a tension cable 76 that is attached to the first carriage 70 and runs across a pulley 15 and is connected to the tension cable connection 10. In a preferred embodiment, the machine 1 includes at least two tension cables 76 (e.g., a primary cable 76*a* and a secondary cable 76*b*) that are each attached to the first carriage 70 and pass respectively through first and second pulleys 15*a*, 15*b* that is attached to the upper section 2. In some embodiments, as shown the first and second pulleys 15*a*, 15*b* are inset into the frame 5 and/or the user support platform 40 to improve safety and storage of the machine 1. It should be appreciated when viewing FIG. 2 that the first pair of lateral support tracks 50 run the entire length of the upper section 2 and lower section 3 of the machine 1 such that they cooperate to form a carriage track that runs the length of the machine when it is in its non-collapsed, elongated position and allow the first carriage 70 to be reversibly moved back and forth along and within the first pair of lateral support tracks 50 within the machine from the upper section 2 to the lower section 3.

Figure 4:
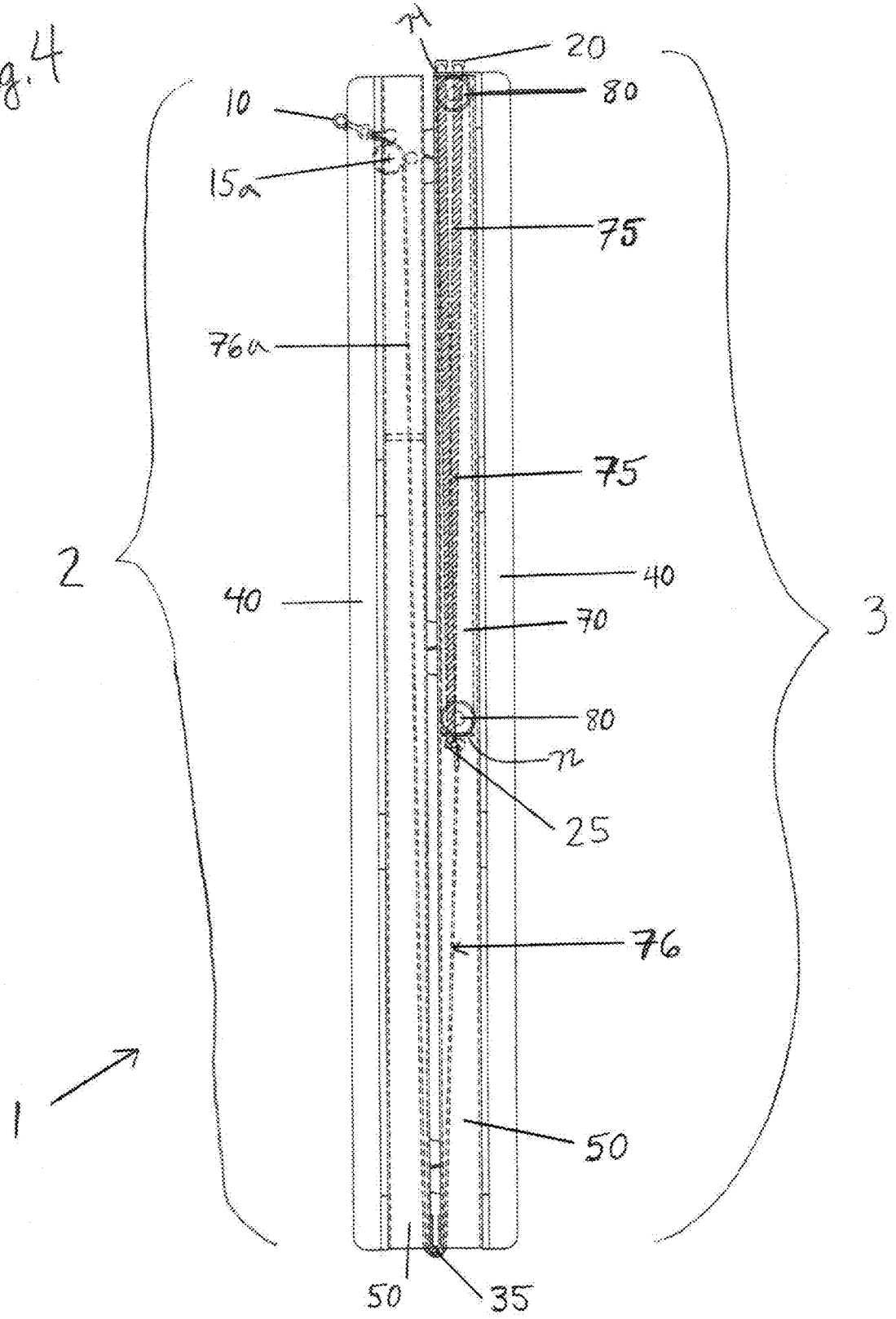
FIG. 4 is a side cross-sectional view of the abdominal exercise machine in its collapsed position.

Referring now to FIG. 4, the abdominal exercise machine 1 is shown from the side while in its collapsed, non-elongated position. The upper section 2 and lower section 3 of the machine main body are comprised of the first pair of lateral support tracks 50 that are rigidly attached to the user support surfaces 40, and in turn, are also connected to each other by at least one hinge 35 that allows for the upper section 2 and lower section 3 of the main body of the machine to be reversibly collapsed together, as shown in FIG. 4. As shown, the machine 1 further comprises a first carriage 70 that is connected to carriage wheels 80 that are movably disposed within the first pair of lateral support tracks 50.

The machine 1 is further comprised of tension cables 76 that are connected on one end to the first carriage 70 and are connected on their other end to tension cable connections 10 (e.g. first tension cable 10*a*, second tension cable 10*b*), and the tension cables 76 run across respective first and second pulleys 15*a*, 15*b* that are housed within and connected first to the upper section of the machine main body. One or more elastic tubes 75 are attached to the first carriage at the first plurality of attachment points 20 and at upper elastic tube attachment points 25.

It should be appreciated that the abdominal exercise machine shown in FIGS. 1-3 illustrates the first carriage 70 in a passive setting and is not in an active setting (e.g., none of the elastic tubes 75 of the first resistance mechanism 73 engaged). In such a passive setting, the ends of the one or more elastic tubes 75 are all detachably connected to the first plurality of attachment points 20 and the upper elastic tube attachment points 25 of the first carriage 70 such that no part of the elastic tubes 75 are connected to the main body of the machine and they are only connected to the first carriage 70 (e.g., connected to the first pulling end 72 and the first storage end 74) and therefore the elastic tubes 75 provide no resistance to movement of the first carriage 70 within the main body of the machine along the two pairs of carriage track 55 that is created by the first pair of lateral support tracks 50. When the abdominal exercise machine 1 is in actual use by a user who is performing abdominal exercises involving resistance training of the user's abdominal muscles, at least one end of one of the elastic tubes 75 will be detachably connected both to the first carriage 70 at the upper elastic tube attachment points 25 and to the lower section 3 of the main body of the machine, thereby providing resistance against movement of the first carriage 70 along the first pair of lateral tracks 250. Such resistance will be in opposition to the force applied by a user through the tension cables 76 that would otherwise pull the first carriage 70 in the direction of the upper section 2 of the main machine body. This active setting can be better appreciated with reference to FIG. 5 discussed below.

Figure 5:
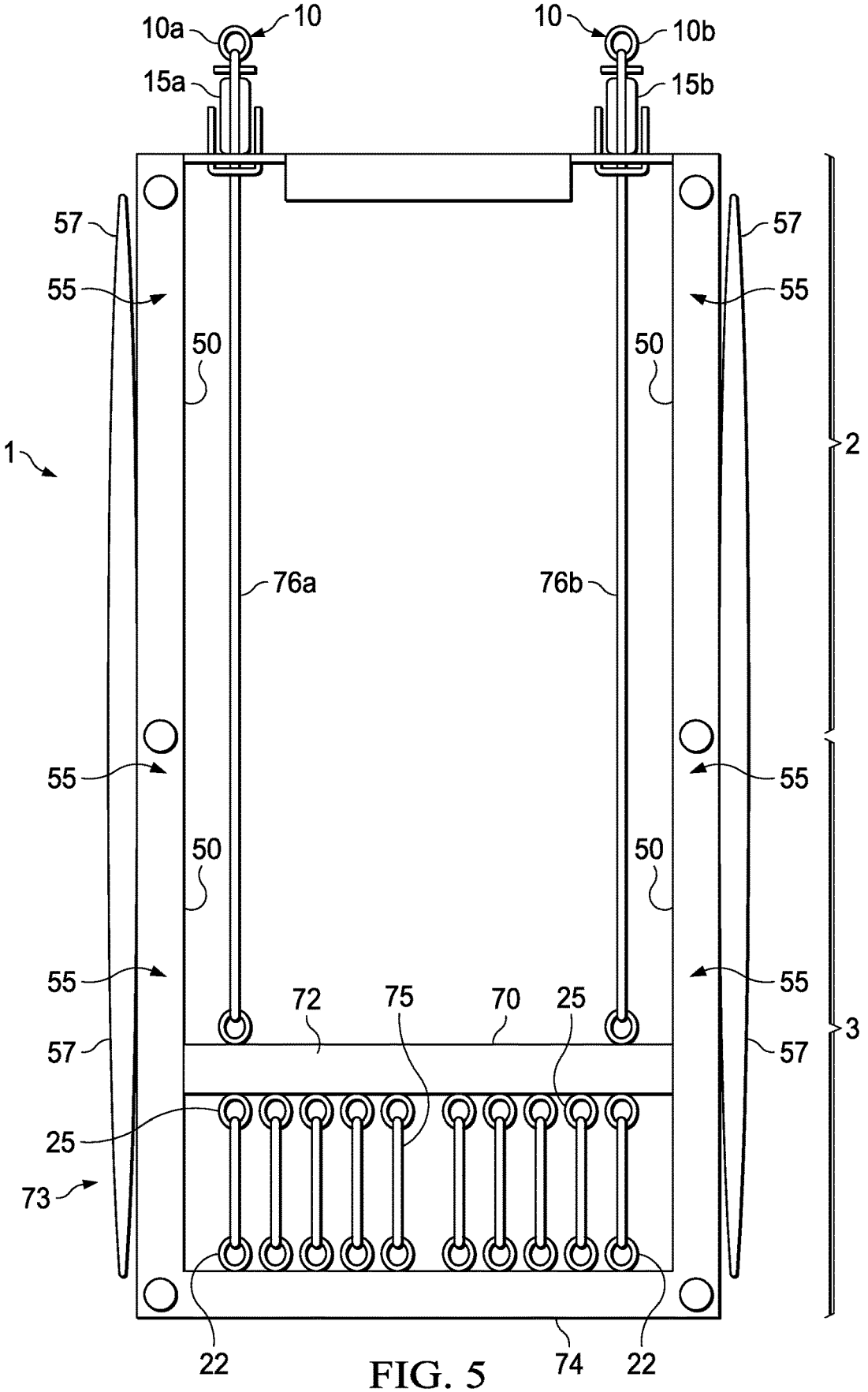
FIG. 5 is a bottom view of one possible embodiment of the abdominal exercise machine in its non-collapsed, fully extended position.

With reference to FIG. 5, an embodiment of the abdominal exercise machine 1 is viewed from the bottom showing the two pairs of carriage tracks 55 on both sides of the machine 1 that are formed by the cooperation of the first pair of lateral support tracks 50 when the machine is in its unfolded position. The first carriage 70 is shown in an active setting wherein multiple elastic tubes 75 are attached both to the upper elastic tube attachment points 25 and to the frame connection points 22 of the lower section 3 of the machine main body. In the preferred embodiment, the frame connection points 22 may be simply notches in the lower end of the lower section 3 of the machine main body itself to which ends of the elastic tubes 75 may be detachably connected in the active setting, or alternatively, they may be rigid protrusions, fingers, rings or similar components that accomplish the same purpose, so long as the one or more elastic tubes 75 may be reversibly attached to the lower end of the tower section 3 at the hinged frame 5 first plurality of attachment points 20 when resistance against movement of the first carriage 70 from the elastic tubes 75 is desired. FIG. 5 otherwise shows the features of the machine 1 that have already been discussed with regard to FIGS. 1-3. This embodiment of the machine is shown as having the primary and secondary cables 76*a*, 76*b* running across two pulleys 15*a*, 15*b* that are connected to and housed within the upper section 2 of the machine main body with the other ends of the tension cables 76 being connected to the first carriage 70. When a user uses the abdominal exercise machine 1 to perform abdominal exercise involving resistance training of the abdominal muscles, such as with abdominal crunches or sit ups while attached to the tension cables 76, it can be appreciated that the user would exert force that is communicated by means of the tension cables 76 to the first carriage 70 in such a manner that the first carriage 70 pulls against the elastic tubes 75 that are connected both to the first carriage 70 and also the lower end of the lower section 3 at the frame connection points 22. As the user moves his body in order to exert force that pulls the tension cables 76 across the first and second pulleys 15*a*, 15*b* and thereby move the first carriage 70 toward, and possibly into, the upper section 2 of the machine main body, the elastic tubes 75 connected to the frame connection points 22 provide resistance to such movement of the first carriage 70 that is transmitted as resisting force along the length of the tension cables 76 thereby providing resistance to the user's movement. FIG. 5 also shows the presence of handles 57 that run along the edges of the machine 1 and allow for a user of the machine to more readily perform eccentric exercise, especially after an initial abdominal crunch or sit up has been performed by the user. The handles 57 may be grasped by a user and held onto as a user of the machine uses his abdominal muscles to actively resist the return of the first carriage 70 toward the lower end of the lower section 3 of the machine as a result of the elastic tubes 75 natural elastic tendency to return to their non-extended position in the lower section 3 of the machine 1. This eccentric exercise will typically take place after a user has already performed an abdominal crunch or a sit up while connected through a harness to the tension cable connections 10 and thereby to the first and second cables 76*a*, 76*b* such that the initial abdominal crunch or sit up exercise of the user has already moved the first carriage 70 toward or into the upper section 2 of the machine 1 and the elastic tubes 75 that are in an active configuration are now stretched and pulling the first carriage 70 back toward the lower end of the lower section 3 of the machine 1. In performing an eccentric exercise with the machine 1, the user will use her abdominal muscles to actively resist the natural movement of the first carriage 70 back toward the frame connection points located on the lower end of the lower section 3 of the machine 1. The user may hold onto the handles 57 in order to assist her abdominal muscles in resisting the movement of the first carriage 70 back toward the lower end of the lower section 3 of the machine 1. This eccentric exercise using the machine 1 provides excellent exercise of the Type II muscle fibers, especially if the user places relatively higher elasticity elastic tubes 75 into an active configuration by attaching them both to the upper elastic tube attachment points 25 and to frame connection points 22 as discussed hereinabove.

Figure 6:
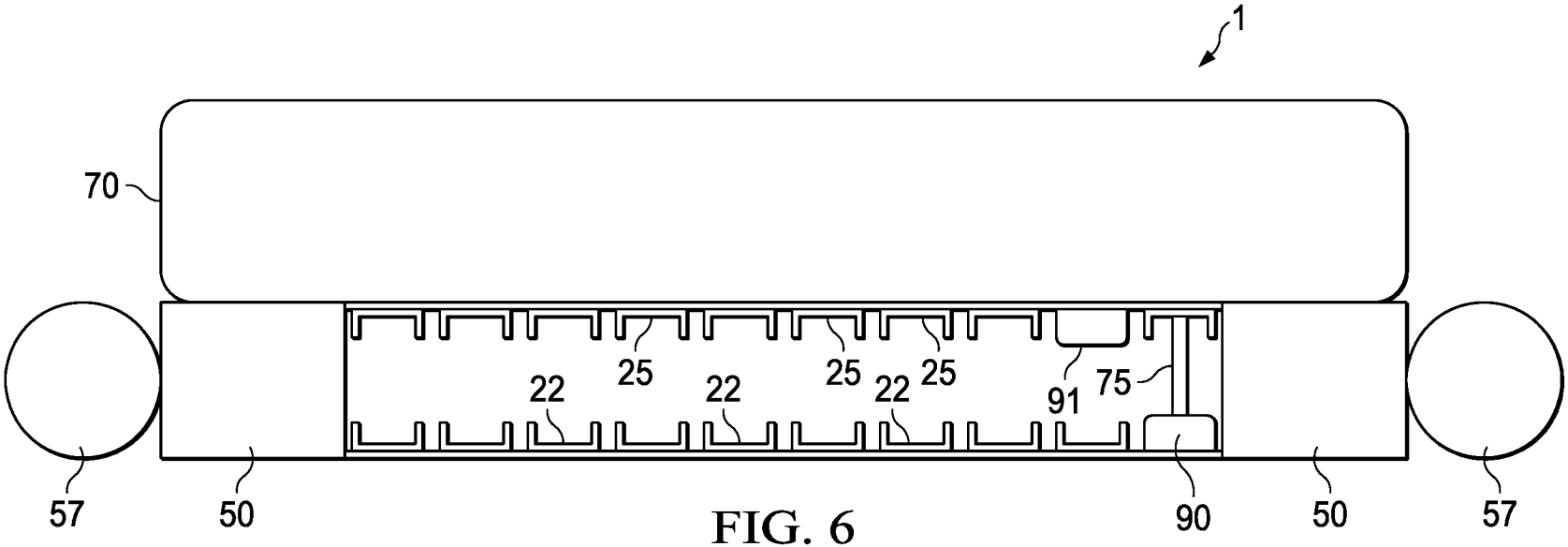
FIG. 6 is a side view of one embodiment of the abdominal exercise machine.

With reference to FIG. 6, a side view of an embodiment of the abdominal exercise machine 1 is presented in which the alternative passive setting and active setting of the first carriage 70 are illustrated. The placement of the ends of the elastic tubes 75 in relation to the upper elastic tube attachment points 25, the first plurality of attachment points 20, and the frame connection points 22 controls whether the first carriage 70 is in an active setting or a passive setting. When at least one elastic tube 75 is attached to the first carriage 70 at an upper elastic tube attachment point 25 and also simultaneously attached 90 to a frame connection point 22 of the lower section 3 of the main body of the machine, then the first carriage 70 is in an active setting and resistance to movement of the first carriage 70 along the carriage track will be provided by the elastic tube 75 that is then simultaneously attached 90 to the lower section 3 of the machine main body. On the other hand, if none of the elastic tubes 75 are attached to a frame connection point 22, but instead are attached only to the upper elastic tube attachment points 25 and the first plurality of attachment points 20 of the first carriage 70, then the elastic tubes are stored 91 on the first carriage 70. When all of the elastic tubes 75 are stored 91, no resistance is provided to movement of the first carriage 70 along the length of the first pair of lateral support tracks 50. FIG. 6 demonstrates the presence of the handles 57 that are attached to the lateral sides of the machine 1.

Figure 7:
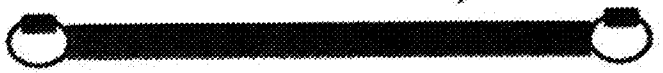
FIG. 7 is a perspective view of a foot strap attachment that may be used in one embodiment of the abdominal exercise machine.

FIG. 7 illustrates a simple foot strap 92 that may be used in one embodiment of the machine by connecting both ends of the foot strap 92 to the tension cable connections previously referenced.

Figure 8:
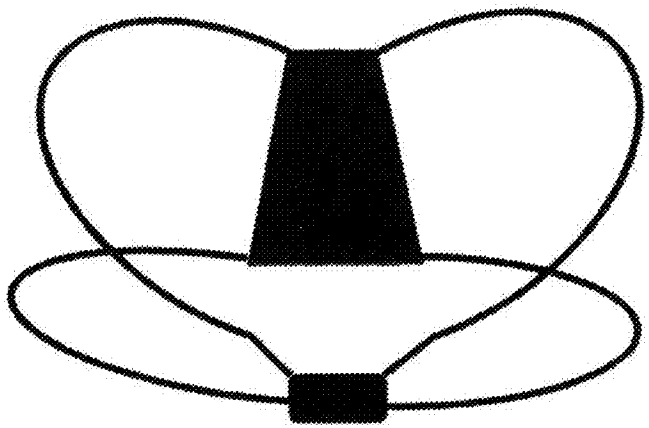
FIG. 8 is a perspective view of a chest strap attachment that may be used in one embodiment of the abdominal exercise machine.

FIG. 8 illustrates a chest strap 94 that may be used in one embodiment of the machine by connecting both ends of the chest strap 94 to the tension cable connections previously referenced.

Figure 9:
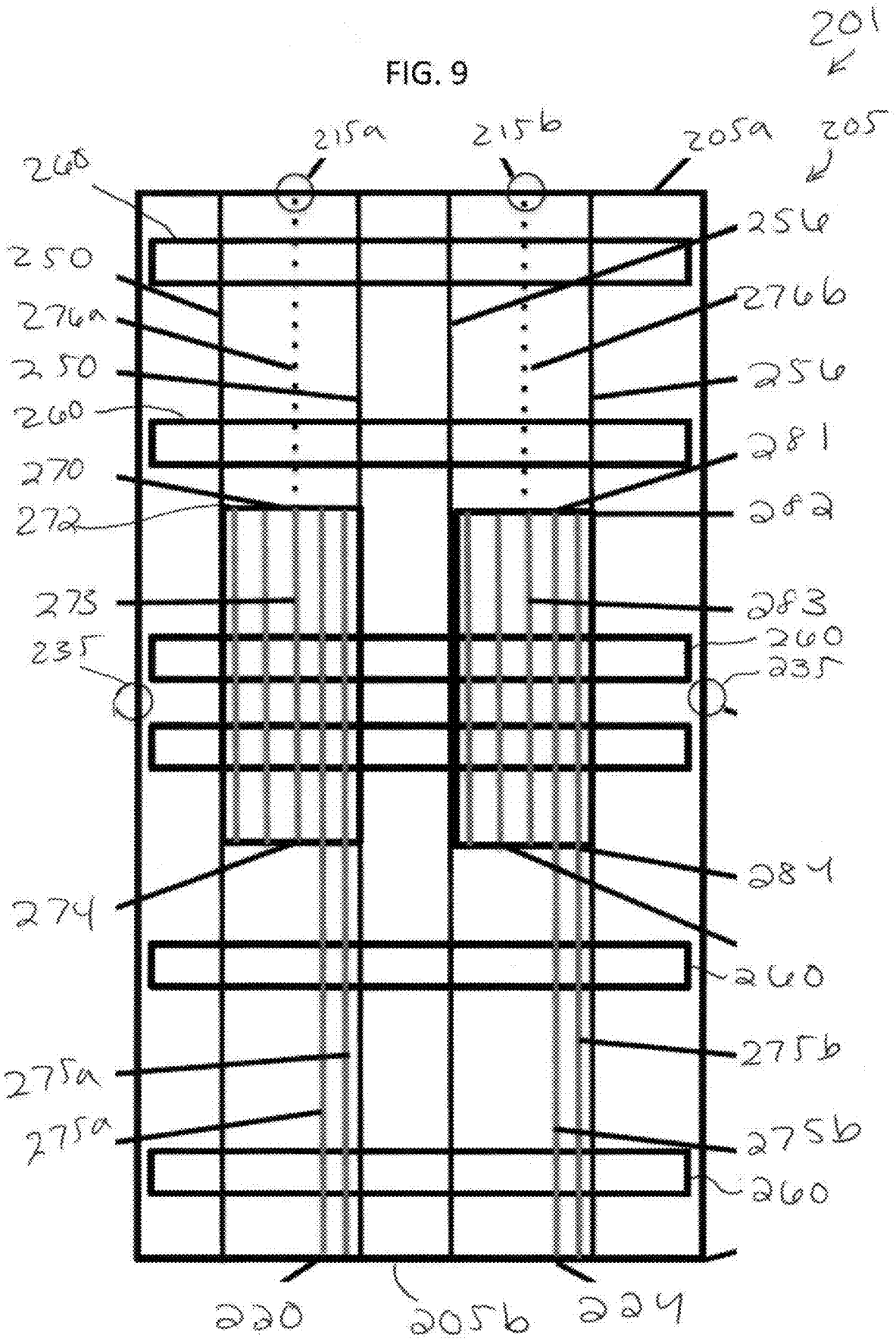
FIG. 9 is a schematic top view an embodiment of the abdominal exercise machine without the user support surface.

FIG. 9 illustrates an embodiment of an exercise machine 201. Certain components of exercise machine 201 are as described above in connection with the exercise machine 1. Those components bear similar reference characters to the components of exercise machine 1, but with a leading "2".

Exercise machine 201 can include a hinged frame 205 including a first pair of lateral support tracks 250 and a second pair of lateral tracks 251, each being disposed under the user support platform (not shown). The hinged frame 205 includes first and second pully 215*a*, 215*b* disposed on the first end 205*a*. The second end 205*b* includes a first plurality of attachment points 220 and a second plurality of attachment points 224.

Exercise machine includes a first carriage 270 movably coupled to the first pair of lateral tracks 250 and a second carriage 281 movably coupled to a second pair of lateral tracks 256. The first carriage 270 having a first pulling end 272 and a first storage end 274. The second carriage 281 having second pulling end 282 and second storage end 284.

Exercise machine 201 includes primary and secondary cables 276*a*, 276*b*. A primary cable 276*a* having a first cable end coupled to the first pulling end 272 of the first carriage 270, passing through the first pulley 215*a*, and a second end coupled to a first handle (not shown). A secondary cable 276*b* having a second cable end coupled to the second pulling end 282 of the second carriage 281, passing through the second pulley 215*b*, and a second end coupled to a second handle (not shown).

Exercise machine 201 can include a first resistance mechanism 273 configured to elastically resist longitudinal movement of the first carriage 270 by the user and a second resistance mechanism 283 configured to elastically resist longitudinal movement of the second carriage 281 by the user. At least some of the elastic tubes 275*a* of the first resistance mechanism 273 are engaged as well as at least some of the elastic tubes 275*b* of the second resistance mechanism 283 to illustrate an active setting. The second resistance mechanism 283 is substantially similar to the first resistance mechanism 273; therefore, the description above related to first resistance mechanism 273 provides one of ordinary skill in the art an understanding of the second resistance mechanism 283. The exercise machine 201 is configured such that movement of the first handle by the user causes movement of the first carriage 270 and deformation of the first resistance mechanism 273 and movement of the second handle by the user causes movement the second carriage 281 and deformation of the second resistance mechanism 283. As a result, the first and second handles can be operated independently and provide different resistances.

The embodiments described herein advantageously provide; a superior to prior mechanical devices focused on providing users with an abdominal workout because the abdominal exercise machine of this application focuses on hypertrophy of Type II muscle fibers and the use of eccentrics; use of the abdominal exercise machine can result in focused, intense exercise of Type II muscle fibers that leads to significant growth of the Type II muscle fiber and noticeable gains in strength and definition of a user's abdominal muscles over the course of multiple workouts; and the abdominal exercise machine's employment of eccentrics, which are commonly referred to as "negatives" in most gyms and in strength training activities, can elicit fast gains in abdominal muscle fibers because Type II muscles are forced to adapt more quickly than with traditional abdominal exercise and strength training.

It may be advantageous to set forth definitions of certain words and phrases used in this patent document. The terms "a" and "an" are defined as one or more unless this disclosure explicitly requires otherwise.

The term "substantially" is defined as largely, but not necessarily wholly, what is specified (and includes what is specified; e.g., substantially 90 degrees includes 90 degrees), as understood by a person of ordinary skill in the art. In any disclosed embodiment, the terms "substantially," "approximately," and "about" may be substituted with "within [a percentage] of" what is specified, where the percentage includes 0.1, 1, 5, and 10 percent.

The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The term "plurality" can mean "at least one". The phrases "associated with" and "associated therewith," as well as derivatives thereof, may mean to include be included within, interconnect with, contain, be contained within, connect to or with, couple to or with, be communicable with, cooperate with, interleave, juxtapose, be proximate to, be bound to or with, have, have a property of, or the like.

Terms such as "first", "second", "primary", and "secondary" are used only to differentiate features and not to limit the different, features to a particular order, importance, or quantity.

At least one embodiment is disclosed and variations, combinations, and/or modifications of the embodiments) and/or features of the embodiment(s) made by a person having ordinary skill in the art is within the scope of the disclosure. Alternative embodiments that result from combining, integrating, and/or omitting features of the embodiment(s) are also within the scope of the disclosure.

What is claimed is:

1. An exercise machine comprising:

a hinged frame configured to fold about a hinge axis in a closed position and to unfold to an open position when in use; the hinged frame comprising:

a user support platform rigidly attaching the hinged frame, a first pair of lateral tracks rigidly attached to and disposed under the user support platform, a first pulley disposed on a first end of the hinged frame, and a second end opposite from the first end;

a first carriage movably coupled to the first pair of lateral tracks, the first carriage having a first pulling end and a first storage end;

a primary cable having a first cable end coupled to the first pulling end of the first carriage, passing through the first pulley, and a second end coupled to a first handle; and a first resistance mechanism configured to elastically resist longitudinal movement of the first carriage by the user, wherein movement of the first handle by the user causes movement of the first carriage relative to the user support platform and deformation of the first resistance mechanism.

2. The exercise machine according to claim 1, wherein the first resistance mechanism is variable so that the resistance can be adjusted by the user.

3. The exercise machine according to claim 2, wherein the hinged frame further comprises a first plurality of attachment points disposed on the second end of the hinged frame, the first resistance mechanism comprises:

a first plurality of elastic resistance components coupled at a first end to the first pulling end of the first carriage and, when not in use, coupled at a second end, to the first storage end of the first carriage and, when in use, coupled at a second end to a corresponding attachment point of the first plurality of attachment points to resist longitudinal movement of the first carriage.

4. The exercise machine according to claim 1, wherein the user support platform comprises an upper section comprising a first rigid planar surface and a lower section comprising a second rigid planar surface, the upper section is adjacent to the lower section such that both the first rigid planar surface and the second rigid planar surface face outwardly in opposite directions when in the closed position.

5. The exercise machine according to claim 1, wherein the hinge axis is disposed at a middle section of the hinged frame.

6. The exercise machine according to claim 1, wherein each of the first pair of lateral tracks includes a hinge on the hinge axis.

7. The exercise machine according to claim 1, wherein the first pulley is inset in the user support platform.

8. The exercise machine according to claim 1, wherein further comprising:

a second pulley disposed on the first end of hinged frame; and a secondary cable having a first cable end coupled to the first pulling end of the first carriage, passing through the second pulley, and a second cable end coupled to a second handle;

wherein movement of the second handle by the user causes deformation of the first resistance mechanism.

9. The exercise machine according to claim 8, wherein movement of the first handle and the second handle jointly cause movement of the first carriage.

10. The exercise machine according to claim 1, wherein: the hinged frame further comprising:

a second pair of lateral tracks disposed under the user support platform;

a second pulley disposed in a first end of the hinged frame;

a second carriage movably coupled to the second pair of lateral tracks, the second carriage having a second pulling end and a second storage end;

a secondary cable having a first end coupled to the second pulling end of the second carriage, passing through the second pulley, and a second end coupled to a second handle; and a second resistance mechanism configured to elastically resist longitudinal movement of the second carriage by the user, wherein movement of the second handle by the user moves the second carriage and deformation of the second resistance mechanism.

11. The exercise machine according to claim 10, rein movement of the first handle and the second handle occurs independently.

12. The exercise machine according to claim 10, wherein the hinged frame further comprises a second plurality of attachment points on the second end of the hinged frame, the second resistance mechanism comprises:

a second plurality of elastic resistance components coupled at a first end to the second pulling end of the second carriage and, when not in use, coupled at a second end, to the second storage end of the second carriage and, when in use, coupled at a second end to a corresponding attachment point in the second plurality of attachment points to resist longitudinal movement of the first carriage.

13. The exercise machine according to claim 10, wherein each of the second pair of lateral tracks includes a hinge on the hinge axis.

14. The exercise machine according to claim 10 wherein the second pulley is inset in the user support platform.

15. An exercise machine comprising:

a hinged frame configured to fold about a hinge axis in a closed position and to unfold to an open position when in use; the hinged frame comprising:

a user support platform rigidly attached to the hinged frame, a first pair of lateral tracks rigidly attached to and disposed under the user support platform, a first pulley disposed on a first end of the hinged frame, a second end opposite from the first end, and a first plurality of attachment points disposed on the second end;

a first carriage movably coupled to the first pair of lateral tracks, the first carriage having a first pulling end and a first storage end;

a primary cable having a first cable end coupled to the first pulling end of the first carriage, passing through the first pulley, and a second end coupled to a first handle; and a first resistance mechanism configured to elastically resist longitudinal movement of the first carriage by the user, the first resistance mechanism comprising:

a first plurality of elastic resistance components coupled at a first end to the first pulling end of the first carriage and, when not in use, coupled at a second end, to the first storage end of the first carriage and, when in use, coupled at a second end to a corresponding attachment point of the first plurality of attachment points to resist longitudinal movement of the first carriage;

wherein movement of the first handle by the user causes movement of the first carriage relative to the user support platform and deformation of the first resistance mechanism.

16. The exercise machine according to claim 15 wherein the hinge axis is disposed at a middle section of the hinged frame.

17. The exercise machine according to claim 16, wherein act the first pair of lateral tracks includes a hinge on the hinge axis.

18. An exercise machine comprising:

a hinged frame configured to fold about a hinge axis in a closed position and to unfold to an open position when in use; the hinged frame comprising:

a user support platform rigidly attached to the hinged frame, a first pair of lateral tracks rigidly attached to and disposed under the user support platform, a second pair of lateral tracks rigidly attached to and under the user support platform, a first pulley disposed on a first end of the hinged frame, a second pulley disposed on a first end of the hinged frame, a second end opposite from the first end, a first plurality of attachment points disposed on the second end, and a second plurality of attachment points disposed on the second end;

a first carriage movably coupled to the first pair of lateral tracks, the first carriage having a first pulling end and a first storage end;

a second carriage movably coupled to the second pair of lateral tracks, the second carriage having second pulling end and second storage end;

a primary cable having a first cable end coupled to the first pulling end of the first carriage, passing through the first pulley, and a second end coupled to a first handle;

a secondary cable having a second cable end coupled to the second pulling end of the second carriage, passing through the second pulley, and a second end coupled to a second handle;

a first resistance mechanism configured to elastically resist longitudinal movement of the first carriage by the user; and a second resistance mechanism configured to elastically resist longitudinal movement of the second carriage by the user;

wherein movement of the first handle by the user causes movement of the first carriage relative to the user platform and deformation of the first resistance mechanism;

wherein movement of the second handle by the user causes movement of the second carriage relative to the user support platform and deformation of the second resistance mechanism.

19. The exercise machine according claim 18, wherein the hinge axis is disposed at a middle section of the hinged frame.

20. The exercise machine according to claim 19, wherein each of the first pair of lateral tracks and second pair of lateral tracks includes a hinge on the hinge axis.

* * * * *